US010823505B2

(12) United States Patent
Womack et al.

(10) Patent No.: US 10,823,505 B2
(45) Date of Patent: Nov. 3, 2020

(54) ALUMINUM WARM FORMING OVEN AND PRODUCTION LINE

(71) Applicants: Darren Womack, Windsor (CA); Mujadded Qureshi, Macomb, MI (US); Tom Sanor, Birmingham, AL (US); Sten Burris, Oxford, MI (US)

(72) Inventors: Darren Womack, Windsor (CA); Mujadded Qureshi, Macomb, MI (US); Tom Sanor, Birmingham, AL (US); Sten Burris, Oxford, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 0 days.

(21) Appl. No.: 15/302,691

(22) PCT Filed: Apr. 15, 2015

(86) PCT No.: PCT/US2015/025910

§ 371 (c)(1),
(2) Date: Oct. 7, 2016

(87) PCT Pub. No.: WO2015/160912

PCT Pub. Date: Oct. 22, 2015

(65) Prior Publication Data

US 2017/0045297 A1 Feb. 16, 2017

Related U.S. Application Data

(60) Provisional application No. 61/979,620, filed on Apr. 15, 2014.

(51) Int. Cl.
*F27D 7/00* (2006.01)
*F27D 3/00* (2006.01)
(Continued)

(52) U.S. Cl.
CPC ..... *F27D 3/0024* (2013.01); *F27B 9/025* (2013.01); *F27D 3/12* (2013.01); *F27D 5/00* (2013.01);
(Continued)

(58) Field of Classification Search
CPC ..... F27D 7/00; F27D 1/18; F27D 3/00
See application file for complete search history.

(56) References Cited

U.S. PATENT DOCUMENTS 3,638,559 A 2/1972 Parker
4,016,986 A * 4/1977 Thomas ..... B65G 1/06 110/177
(Continued)

FOREIGN PATENT DOCUMENTS

CN 2532082 Y 1/2003
CN 2913998 Y 6/2007
(Continued)

OTHER PUBLICATIONS

International Search Report and Written Opinion regarding PCT/US2015/0258910 dated Jul. 10, 2015.

*Primary Examiner* — Gregory A Wilson
(74) *Attorney, Agent, or Firm* — Dickinson Wright PLLC

(57) ABSTRACT

A multi-window platen oven for simultaneously heating a plurality of blanks, for example aluminum blanks, before forming the heated blanks in a production line is provided. The oven includes a plurality of vertically aligned shelves disposed in an existing press assembly so that no additional floor space is required. The shelves are attachable to an upper press bed and one another. The upper press bed lifts the attached shelves to present an open window for receiving an unheated blank and/or removing a heated blank from the oven. The remaining windows remain closed and continue heating while the blanks are transferred to and from the oven. After closing the one open window, another window
(Continued)

opens to receive another unheated blank and/or remove another heated blank. Thus, the multi-window platen oven continuously provides blanks which are ready for warm or hot forming.

12 Claims, 18 Drawing Sheets

(51) Int. Cl.

| | |
|---|---|
| ***F27B 9/02*** | (2006.01) |
| ***F27D 3/12*** | (2006.01) |
| ***F27D 5/00*** | (2006.01) |
| ***F27D 15/00*** | (2006.01) |

(52) U.S. Cl.
CPC ..... *F27D 15/00* (2013.01); *F27D 2003/0086* (2013.01)

(56) References Cited

U.S. PATENT DOCUMENTS

| | | | | |
|---|---|---|---|---|
| 4,863,552 | A | 9/1989 | Ishida et al. | |
| 6,036,485 | A | 3/2000 | Benedetti | |
| 2006/0127067 | A1 | 6/2006 | Wintenberger et al. | |
| 2012/0073108 | A1 | 3/2012 | McNally | |
| 2013/0273486 | A1 * | 10/2013 | Dvorak ..... | F27D 7/00 432/9 |

FOREIGN PATENT DOCUMENTS

| | | | | |
|---|---|---|---|---|
| CN | 2933002 | Y | 8/2007 | |
| CN | 103299148 | A | 9/2013 | |
| CN | 103375987 | A | 10/2013 | |
| CN | 103512354 | A | 1/2014 | |
| EP | 2090857 | A1 * | 8/2009 | ..... C21D 9/34 |
| JP | H05203364 | A | 8/1993 | |
| JP | 3173375 | U | 2/2012 | |

* cited by examiner

ALUMINUM WARM FORMING OVEN AND PRODUCTION LINE

CROSS REFERENCE TO RELATED APPLICATION

This U.S. National Stage Patent Application claims priority to PCT patent application no. PCT/US2015/025910, filed Apr. 15, 2015 entitled "Aluminum Warm Forming Oven And Production Line", which claims the benefit of and priority to U.S. Provisional Patent Application Serial No. 61/979,620 filed Apr. 15, 2014 entitled "Aluminum Warm Forming Oven And Production Line", the entire disclosures of the applications being considered part of the disclosure of this application and hereby incorporated herein by reference.

BACKGROUND OF THE INVENTION

1. Field of the Invention

The invention relates generally to methods for providing a plurality of heated blanks and oven assemblies for heating the blanks, including methods and assemblies used to warm or hot form aluminum parts in a production line.

2. Related Art

Warm or hot forming is oftentimes used to manufacture aluminum parts for automotive vehicles, such as structural body or chassis components. The process typically includes heating an aluminum blank in an oven, and then transferring the heated blank to one or more forming stations to form the blank into a part having a desired shape. Warm forming typically occurs while the aluminum blank is at temperatures of 200 to 400° C., and hot forming typically occurs at temperatures greater than 400° C. Oftentimes, warm or hot forming is not a viable option, as the oven used to heat the blank requires a significant amount of floor space, which may not be available. In addition, warm and hot forming processes typically include significant delays while the blank is being heated to the required temperature.

SUMMARY OF THE INVENTION

The invention provides a method for simultaneously heating a plurality of blanks using a multi-window oven assembly, for example prior to warm or hot forming aluminum blanks in a production line. The multi-window oven assembly includes an upper press bed, a lower press bed vertically aligned with the upper press bed, and a plurality of shelves vertically aligned with and disposed between the press beds. At least one of the press beds is movable vertically relative to the other press bed, and at least one of the shelves is coupled to at least one of the press beds. The method then includes disposing at least one blank on at least two of the shelves or on the lower press bed and at least one shelf; and simultaneously heating the shelves to heat the blanks.

The invention also provides a method of forming a plurality of parts in a production line. This method includes the steps of providing the multi-window oven assembly; disposing at least one blank on at least two of the shelves or on the lower press bed and at least one shelf; simultaneously heating the at least two shelves and the blanks disposed on the heated shelves; and forming the heated blanks in the production line after heating the blanks with the multi-window oven assembly.

During an example aluminum warm forming process using the multi-window oven assembly, one window of the oven between adjacent shelves is open for receiving an unheated aluminum blank or allowing a heated aluminum blank to be removed from the oven and transferred to a forming station while the other windows between adjacent shelves remain closed to continue heating the aluminum blanks disposed on those shelves. As soon as one heated blank is removed from a shelf for subsequent forming, an unheated aluminum blank can be disposed on that open shelf. At least one heated aluminum blank is always ready for forming, and thus process delays are eliminated or reduced. In addition, the multi-window oven assembly can be designed to fit into a station of a standard production line so that additional floor space for the oven is not required.

BRIEF DESCRIPTION OF THE DRAWINGS

Other advantages of the present invention will be readily appreciated, as the same becomes better understood by reference to the following detailed description when considered in connection with the accompanying drawings wherein:

FIGS. 1B-8B are perspective views of a press assembly according to another exemplary embodiment in the same positions as the press assembly of FIGS. 1A-8A;

DESCRIPTION OF THE ENABLING EMBODIMENT

Figure 1A:
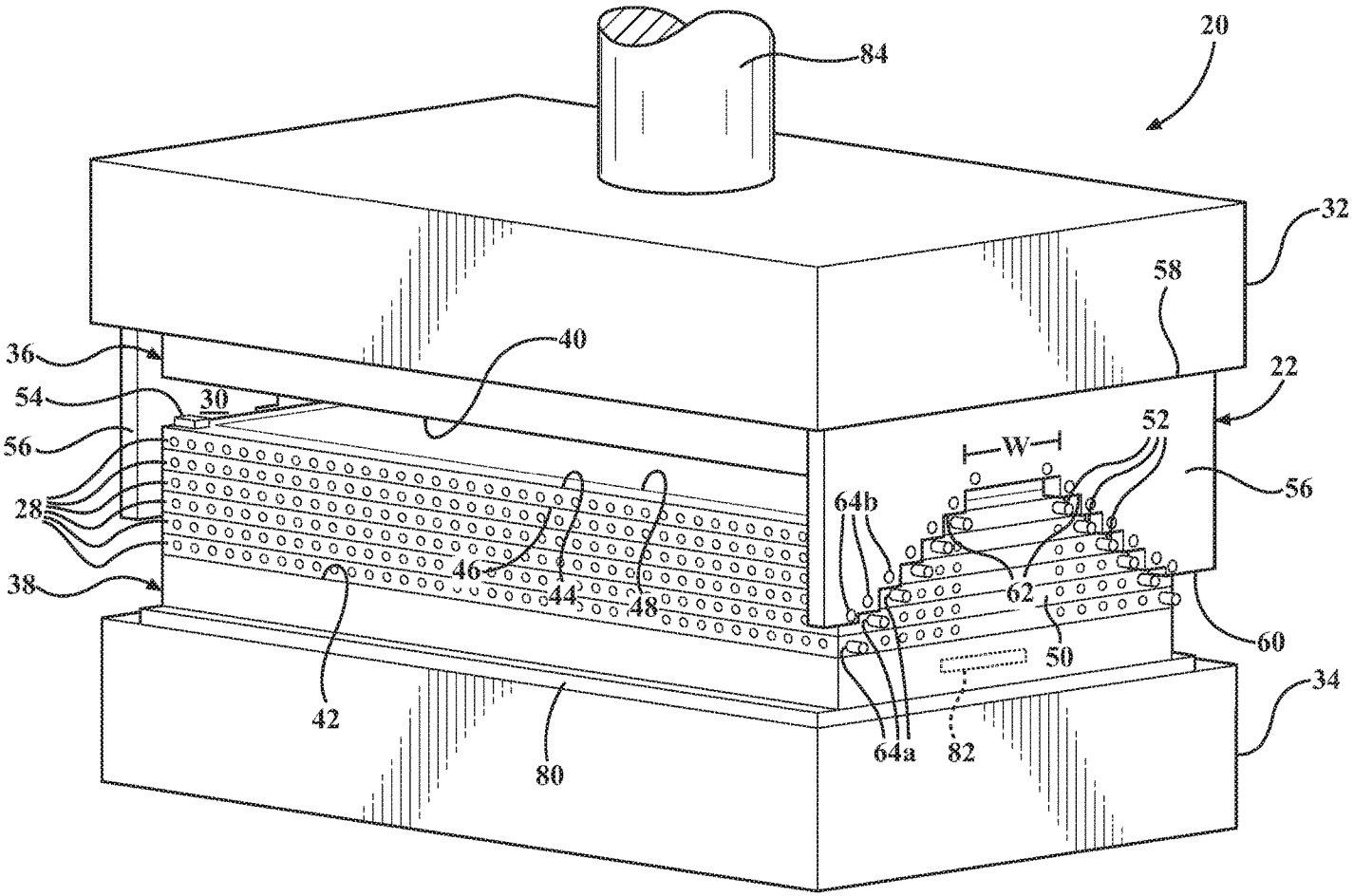
FIG. 1A is a perspective view of an exemplary press assembly including a multi-window platen oven in a first open position.

The invention provides a press assembly 20 including a multi-window platen oven 22, together referred to as a multi-window oven assembly, as shown in FIGS. 1A-8A and 1B-8B. The multi-window platen oven 22 simultaneously heats a plurality of aluminum blanks, typically sheets of aluminum or aluminum alloy, prior to forming the aluminum blanks into a part having a desired shape, such as a deep drawn part for an automotive vehicle application. The multi-window oven assembly is typically used in an aluminum warm forming process, but could alternatively be used in a hot forming process. In an example embodiment shown in FIG. 9, the multi-window oven assembly is disposed at the beginning of a production line 24 which includes a plurality of stations 26, for example forming stations or other types of stations used to manufacture the part. The multi-window platen oven 22 includes a plurality of heated shelves 28 presenting a plurality of windows 30 therebetween for receiving and heating the aluminum blanks. As soon as one heated blank is removed from one shelf 28 and transferred to one of the stations 26, another, unheated, aluminum blank is disposed on that open shelf 28. In addition, once the heated blank leaves the station 26, another heated blank is immediately transferred from another shelf 28 of the platen oven 22 to the station 26. The multi-window platen oven 22 continuously provides heated blanks which are ready for warm forming, and thus a more efficient production line 24 is achieved. In addition, the multi-oven assembly can fit into one of multiple stations 26 of an existing production line, and thus the platen oven 22 does not require any additional floor space.

Figure 6A:
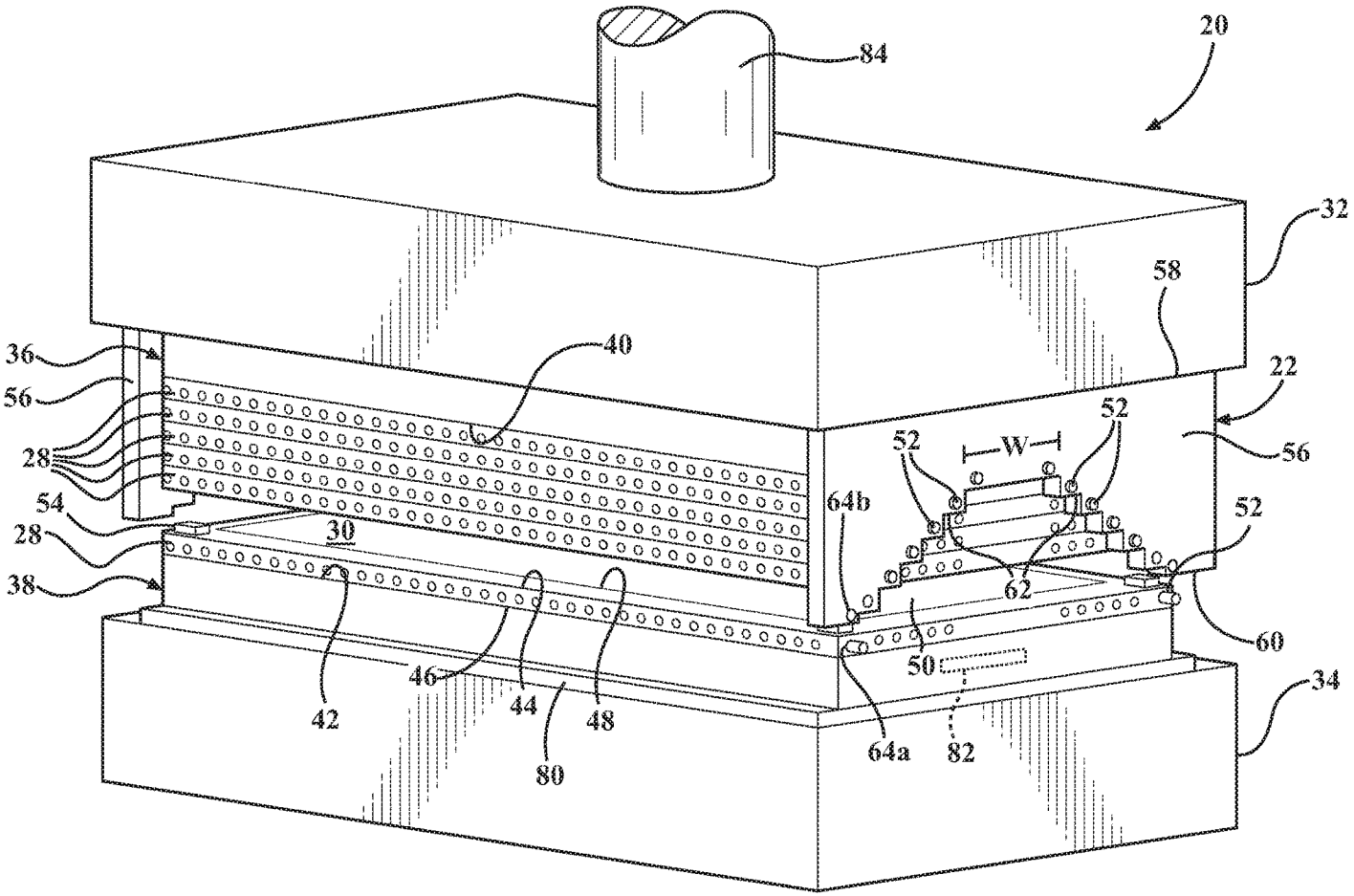
FIG. 6A is a perspective view of the press assembly of FIG. 1A in a sixth open position.
Figure 6B:
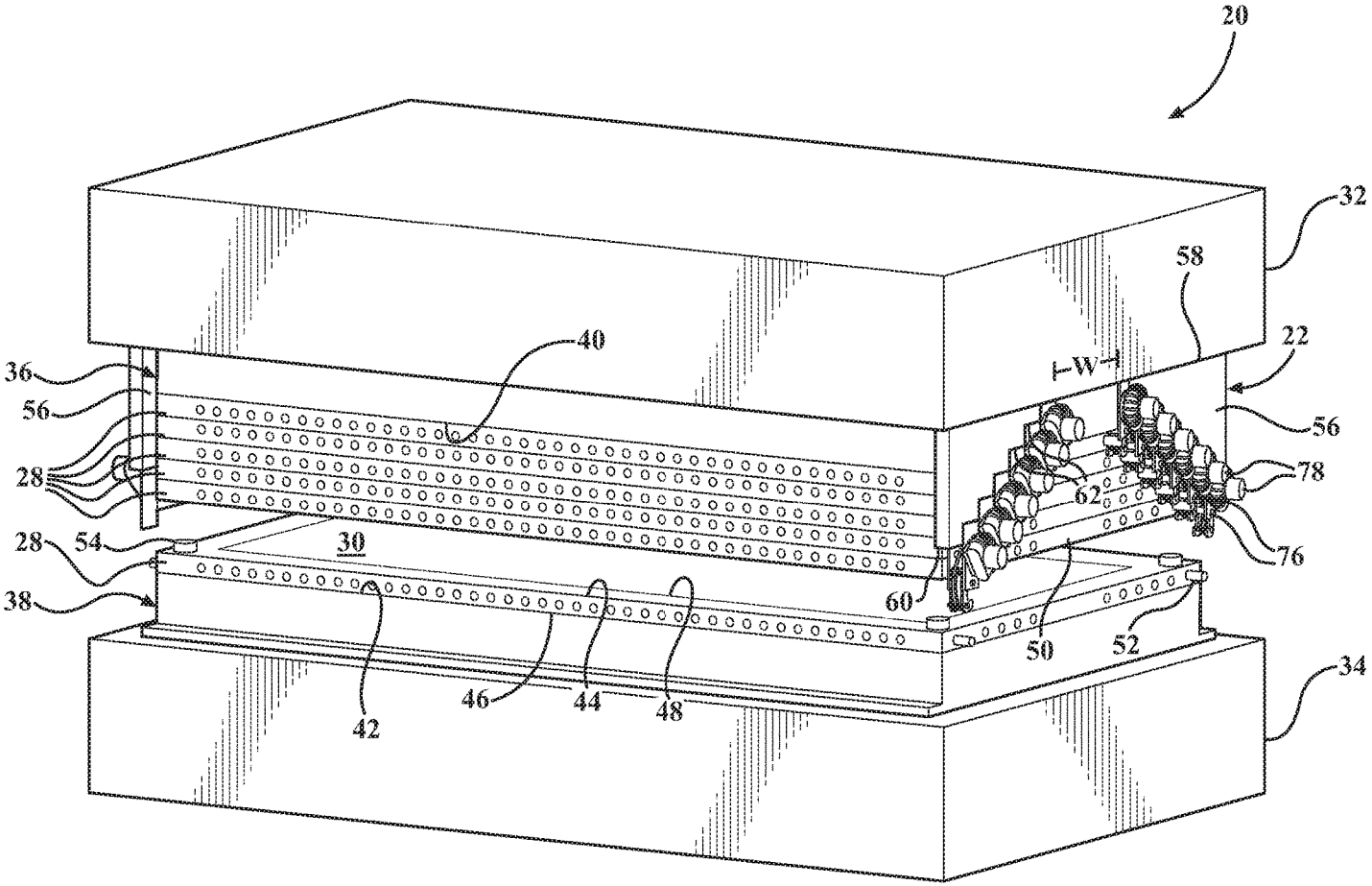
Figure 7A:
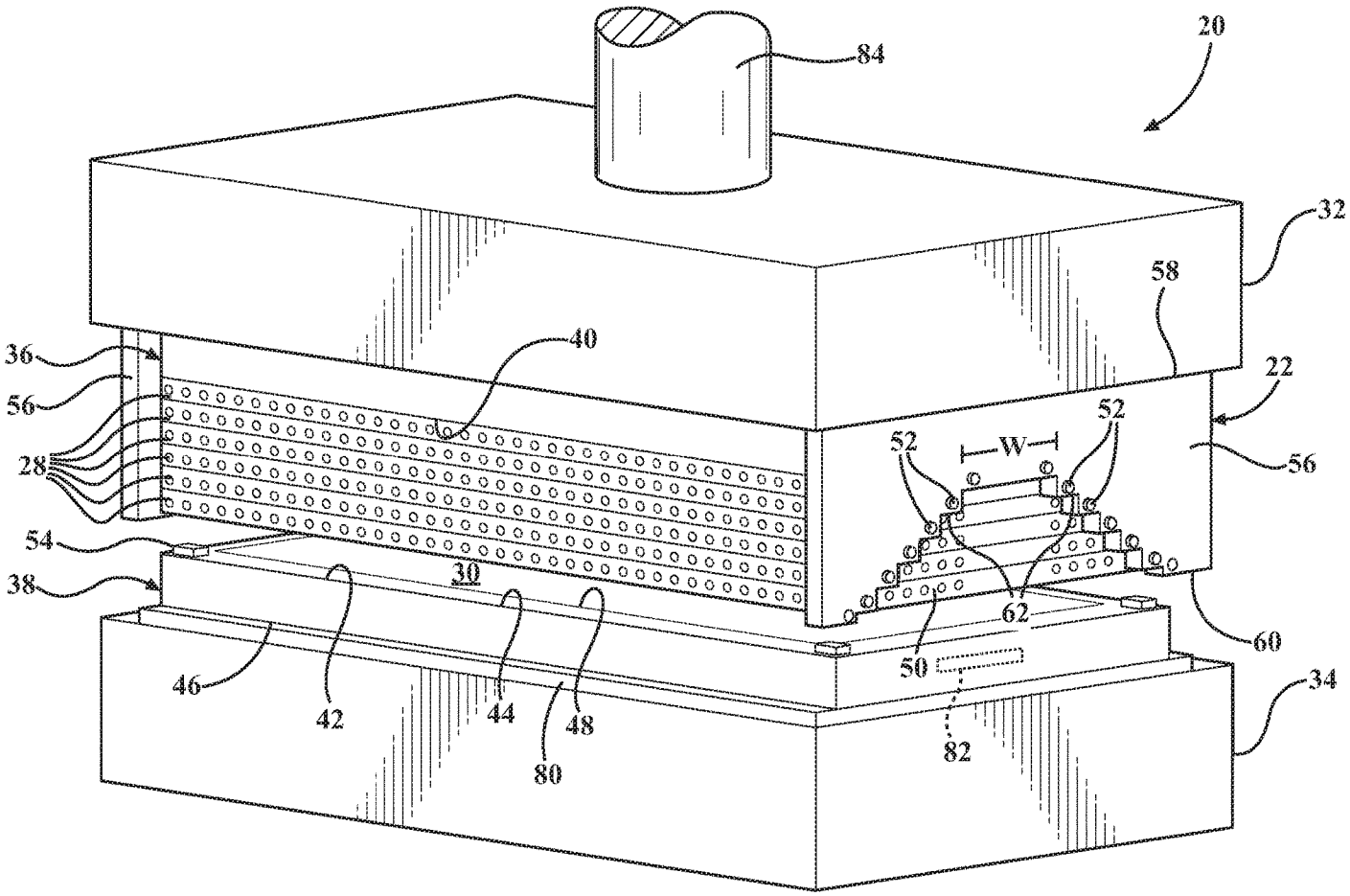
FIG. 7A is a perspective view of the press assembly of FIG. 1A in a seventh open position.
Figure 7B:
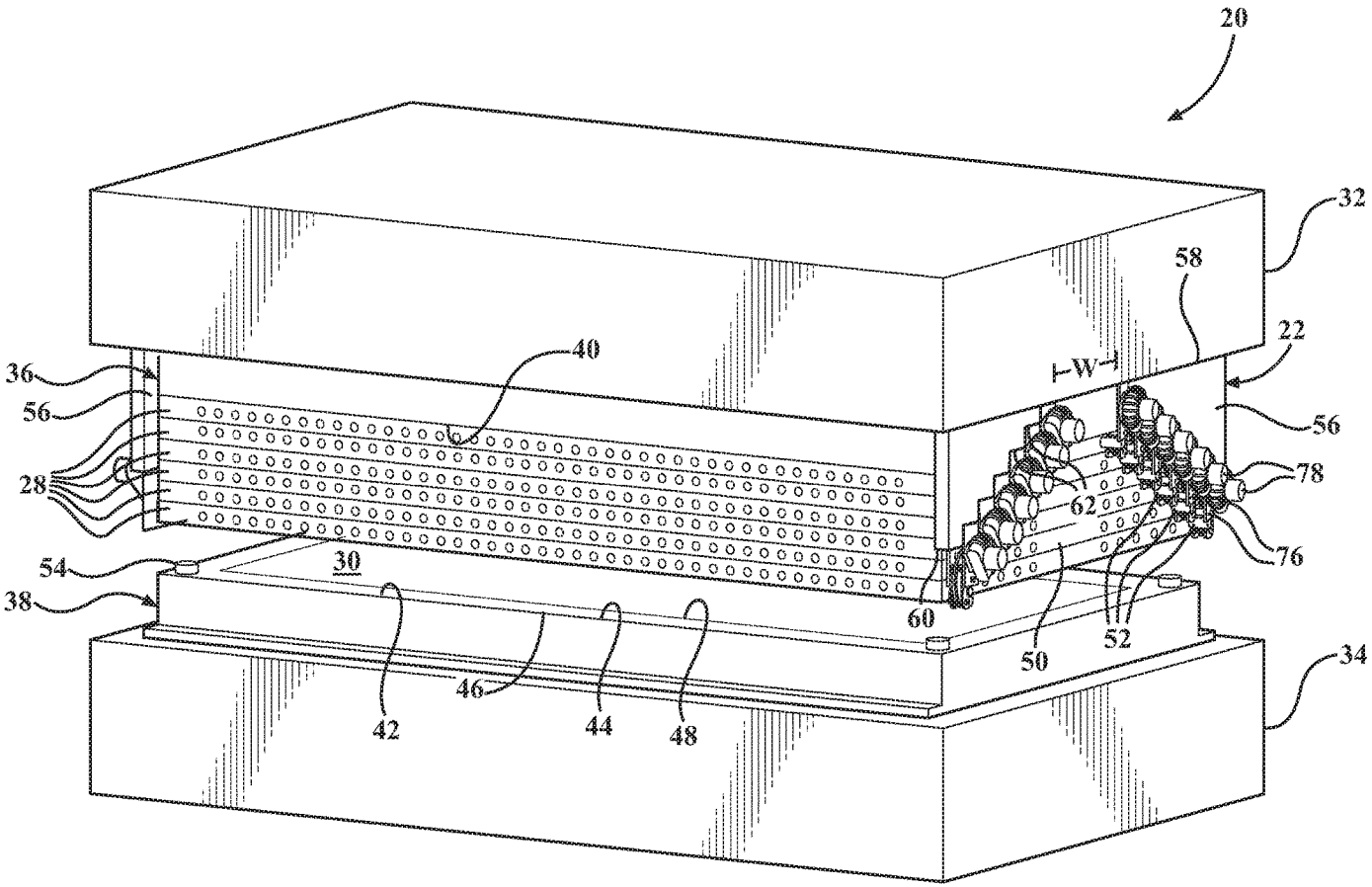
Figure 8A:
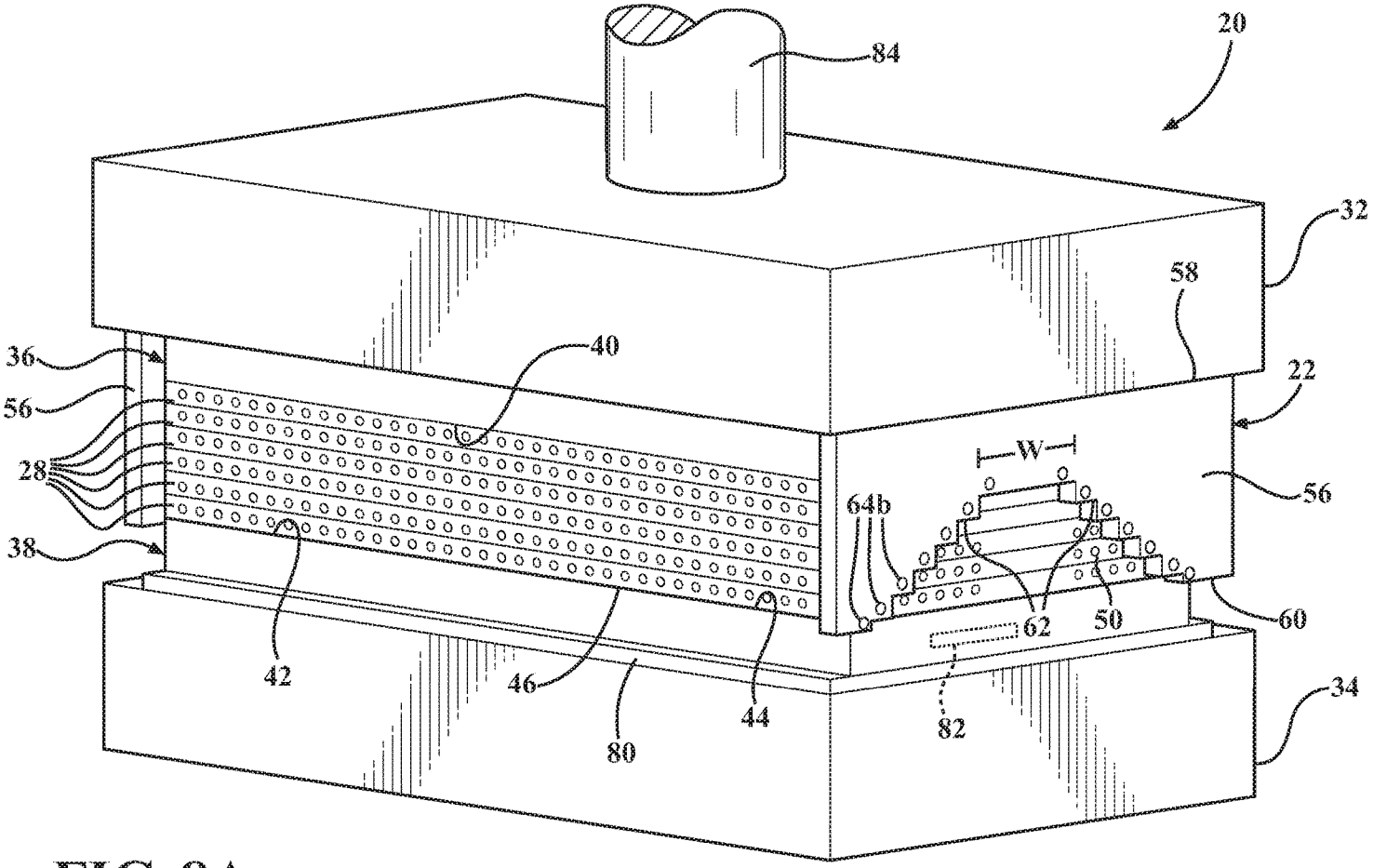
FIG. 8A is a perspective view of the press assembly of FIG. 1A in closed position.
Figure 8B:
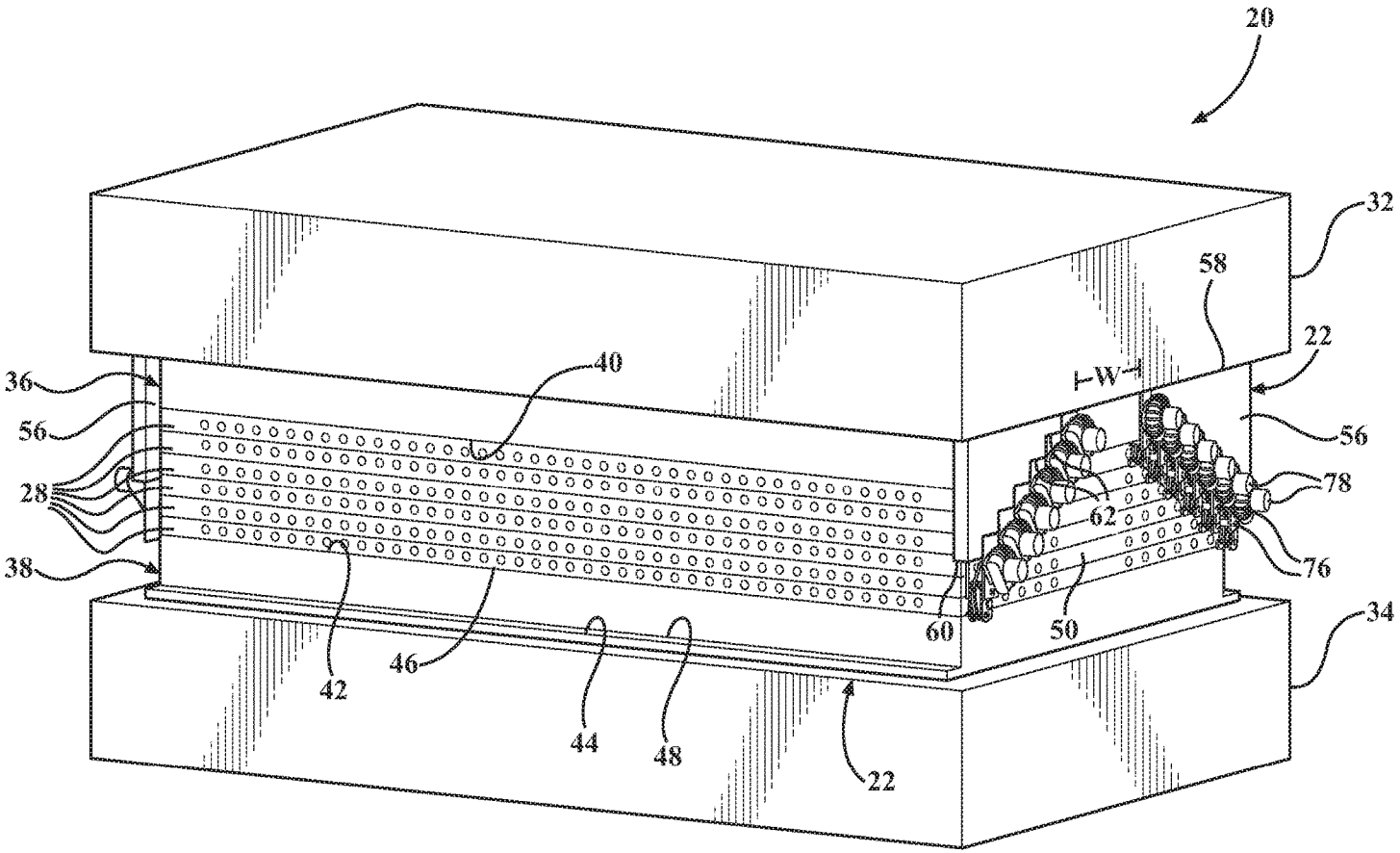

FIGS. 1A-8A and 1B-8B are perspective views of the multi-window oven assembly according to one exemplary embodiment. FIGS. 1A-7A and 1B-7B show the multi-window oven assembly in seven different open positions, and FIGS. 8A and 8B show the multi-window oven assembly in a closed position. The multi-window platen oven 22 can be incorporated into a conventional press assembly, such as the press assembly 20 of FIG. 1A-8A or 1B-8B including an upper press bed 32 and a lower press bed 34. The platen oven 22 includes an upper platen 36 which is easily installed and fixedly attached to the upper press bed 32, and a lower platen 38 which is easily installed and fixedly attached to the lower press bed 34. The upper platen 36 presents an upper platen surface 40 for engaging an aluminum blank and the lower platen 38 presents a lower platen surface 42 for supporting an aluminum blank. The platen surfaces 40, 42 are typically planar and extend parallel to one another. Each platen 36,38 and the shelves 28 are heated using any type of heating device (82 disposed along the shelves 28, for example the heating device 82 shown in FIGS. 1A, 2A, 3A, 4A, 5A, 6A, 7A, and 8A which is incorporated into the platen. Alternatively the heating device 82 could be coupled to the platen 36, 38. The platens 36, 38 can be heated to different temperatures, if desired, and even different sections of the platens 36, 38 can be heated to different temperatures, if desired.

The oven 22 also includes the plurality of shelves 28 disposed between the upper platen 36 and the lower platen 38. In the exemplary embodiments shown in FIGS. 1A-8A and 1B-8B, the oven 22 includes six shelves 28, but the oven 22 could include more or fewer shelves 28, depending on the desired level of production. Each shelf 28 presents an upper shelf surface 44 facing toward the upper press bed 32 and a lower shelf surface 46 facing toward the lower press bed 34. The upper and lower shelf surfaces 44, 46 are typically planar and extend parallel to the upper and lower platen surfaces 40, 42. In the exemplary embodiments, each lower shelf surface 46, as well as the lower platen surface 42, includes a recessed area 48 for receiving at least one aluminum blank, such that when the oven 22 is closed, as shown in FIGS. 8A and 8B, the aluminum blanks are sealed off or at least protected from the surrounding environment. The shelves 28 typically all have the same geometry and dimensions and are vertically aligned with one another. In the exemplary embodiment, each shelf 28 extends longitudinally between opposite shelf ends 50 and has a rectangular shape. Each shelf 28 can also be heated by any type of heating device 82 disposed along the shelf 28, for example incorporated into the shelf 28 or coupled to the shelf 28. The shelves 28 can be heated to different temperatures, if desired, and different sections of the shelves 28 can be heated to different temperatures, if desired. The blanks are heated from room temperature to an appropriate forming temperature between a pair of the shelves 28, or between one shelf 28 and one platen 36, 38.

In the exemplary embodiments, each shelf includes a plurality of pin openings 64*a*, for example a pair of pin openings 64*a* for receiving a pair of pins 52, the purpose of which will be discussed further below. In addition, alignment pieces 54 are typically disposed at the corners of each lower shelf surface 46, and at the corners of the lower platen surface 42. In the exemplary embodiments, the alignment pieces 54 are posts, but could alternatively comprise another structure. When the press assembly 20 is closed, the alignment pieces 54 extend into alignment slots (not shown) located at the corners of the lower shelf surfaces 46 and at the corners of the upper platen surface 40.

The multi-window platen oven 22 also includes side walls 56 extending longitudinally along each of the shelf ends 50. As shown in the Figures, each side wall 56 includes an upper wall end 58 attached to the upper press bed 32 and a lower wall end 60 which remains spaced from the lower press bed 34 even when the press assembly 20 is closed. Each side wall 56 presents a plurality of ledges 62 disposed between the upper wall end 58 and the lower wall end 60 and facing toward the lower press bed 34. Each ledge 62 presents a width w, and the width w of the ledges 62 increases between the upper press bed 32 and the lower press bed 34. In other words, each side wall 56 presents a pair of opposing steps between the upper wall end 58 and the lower wall end 60.

The shelves 28 can be coupled to the upper press bed 32 and uncoupled from the upper press bed 32 throughout the production process, as shown in FIGS. 1A-8A and 1B-8B, using various different techniques. In the example embodiments, the side walls 56 each includes a pair of pin openings 64*b* disposed beneath each ledge 62 for receiving the pairs of pins 52 which then extend into the pin openings 64*a* of the shelf ends 50. The pins 52 slide horizontally into and out of the pin openings 64*a* and 64*b* to couple or uncouple the associated shelf 28 from the upper press bed 32. In one embodiment, a mechanical or electrical actuator is associated each of the platens 36, 38 to slide the pins 52 in and out of the pin openings 64*a* and 64*b* to couple or uncouple the shelves 28. Alternatively, a human or robot 74, such as one of the robots 74 shown in FIG. 9, slides the pins 52 in and out of the pin openings 64*a* and 64*b*.

Figure 10A:
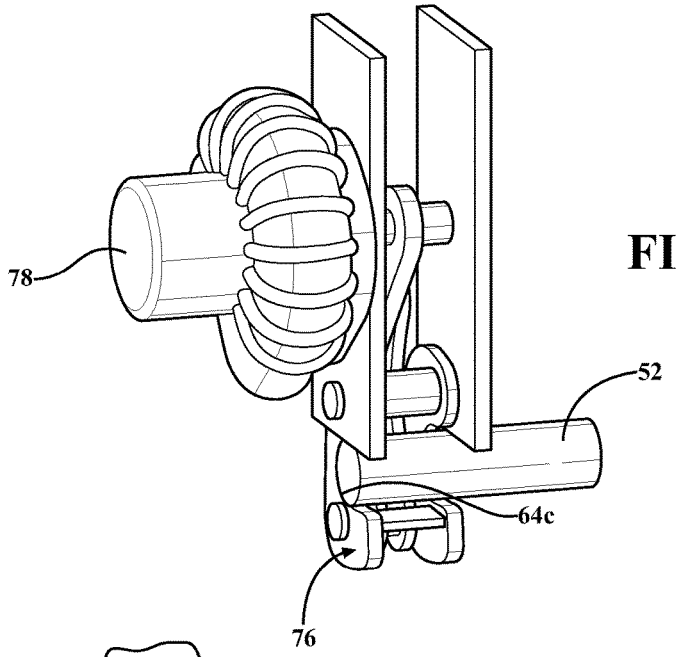
FIGS. 10A-10C are perspective views of a locking mechanism of the press assembly shown in FIGS. 1B-8B.
Figure 10B:
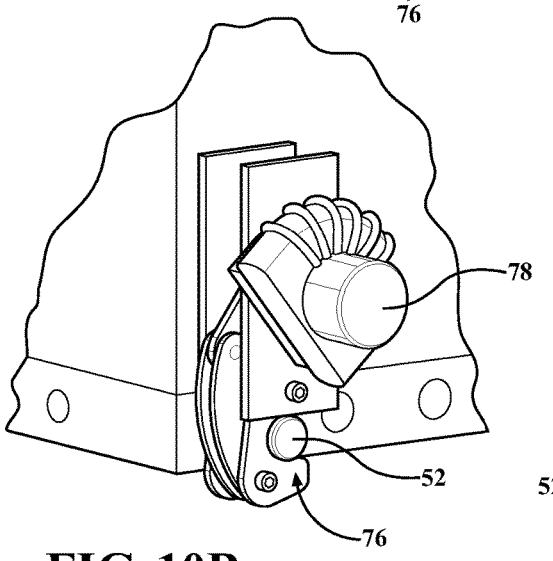
Figure 10C:
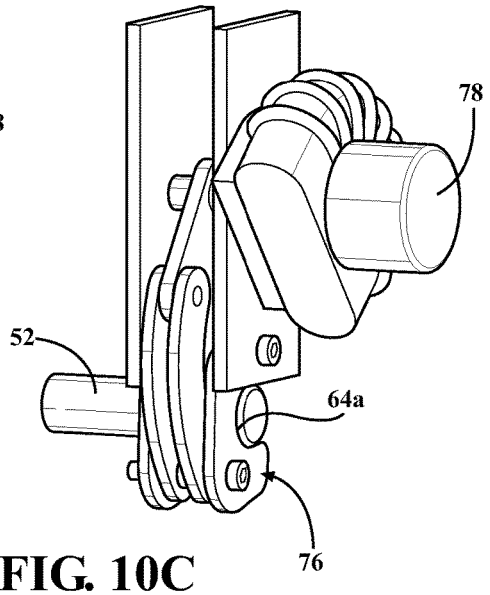

In the other exemplary embodiment shown in FIGS. 1B-8B, the multi-window oven assembly includes a locking mechanism for engaging and disengaging the pins 52. In this embodiment, the pins 52 remain in a fixed position relative to the shelf ends 50, and hooks 76 each presenting a pin opening 64*c* are disposed adjacent each ledge 62 for engaging the corresponding pair of pins 52. Each hook 76 is coupled to a knob 78, which is attached to the ledge 62, and the knob 78 is rotated to latch or unlatch the associated hook 76 from the associated pin 52, and thus couple or uncouple the associated shelf 28 from the upper press bed 32. FIGS. 10A-10C are enlarged views of the locking mechanism including the knob 78 and hook 76 according to one exemplary embodiment. However, it should be appreciated that other methods or techniques could be used to couple and uncouple the shelves 28 from the upper press bed 32.

The shelves 28 coupled to the upper press bed 32, as well as any shelves 28 disposed between the coupled shelves 28 and the upper press bed 32, move vertically with the upper press bed 32 as the press assembly 20 opens and closes. The number of shelves 28 coupled to the upper press bed 32 continuously changes throughout the production process in order to open and close the windows 30 of the oven 22 at different times, continuously remove the heated aluminum blanks from the oven 22, and replace those removed heated blanks with unheated blanks.

The press assembly 20 typically includes a press actuator 84 coupled to the upper press bed 32 for raising and lowering the upper press bed 32, together with the upper platen 36 and/or at least one of the shelves 28, to present one of the windows 30 between adjacent shelves 28, or between at least one shelf 28 and one of the platens 36, 38. In an alternate embodiment, the press actuator 84 could also be coupled to the lower press bed 34 for raising and lowering the lower platen 38.

The number of open positions achieved by the multi-window platen oven 22 corresponds to the number of windows 30 that can be provided between the shelves 28 and platens 36, 38 of the oven 22. In each open position, one window 30 for receiving at least one unheated aluminum blank is provided between one shelf 28 and the adjacent shelf 28, or between one shelf 28 and one platen 36, 38. In the exemplary embodiments shown in FIGS. 1A-8A and 1B-8B, the oven 22 includes six shelves 28 and thus seven open positions. Once the at least one aluminum blank is disposed on one of the shelves 28 or lower platen 38, the upper press bed 32 moves toward the lower press bed 34 to close the window 30 and heat the at least one aluminum blank. Only one window 30 is open at a time. Thus, while at least one aluminum blank is inserted or removed from one shelf 28, the other aluminum blanks disposed on the other shelves 28 and lower platen 38 continue to be efficiently heated. Any drive mechanism known in the art can be used to move the upper press bed 32 and attached shelves 28 relative to the lower press bed 34.

Figure 1B:
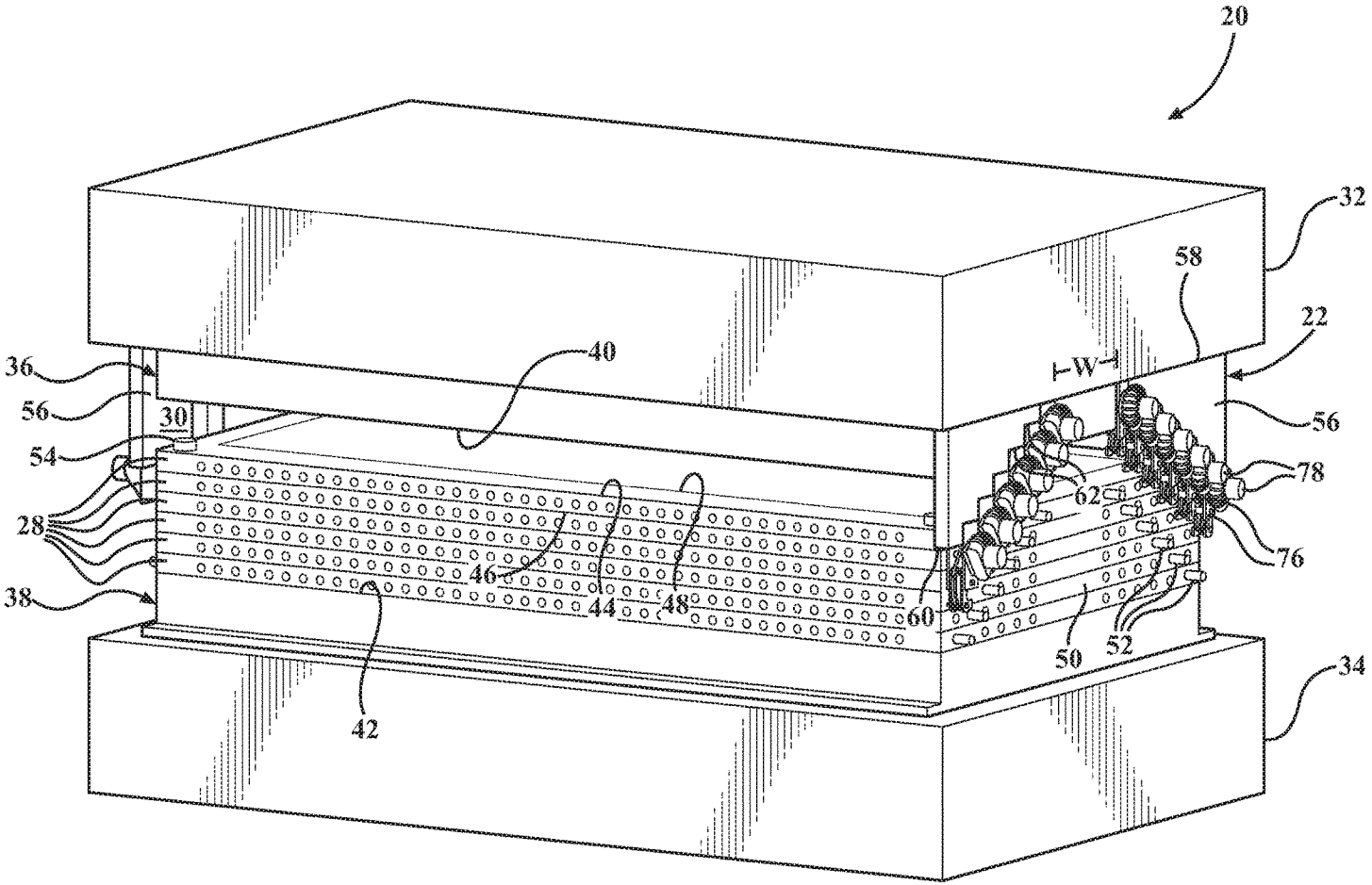

FIGS. 1A and 1B show the multi-window platen oven 22 in a first open position. In this position, none of the pins 52 extend into the pin openings 64*b* of the side walls 56, and none of the pins are received in the pin openings 64*c* of the hooks 76. Thus, when the upper press bed 32 moves upward away from the lower press bed 34, all of the shelves 28 rest on the lower press bed 34, and a first (uppermost) window 30 is provided between the upper platen 36 and the first (uppermost) shelf 28. When the oven 22 is in the first open position, the aluminum blanks can be inserted into the first window 30 and disposed on the first shelf 28 for heating, or removed from the first shelf 28 for subsequent forming. In the first open position, only the first window 30 is open. The other windows 30 remain closed and thus any blanks disposed on the other shelves 28 or on the lower platen 38 remain sealed or at least protected from the environment and continue to be efficiently heated.

Figure 2A:
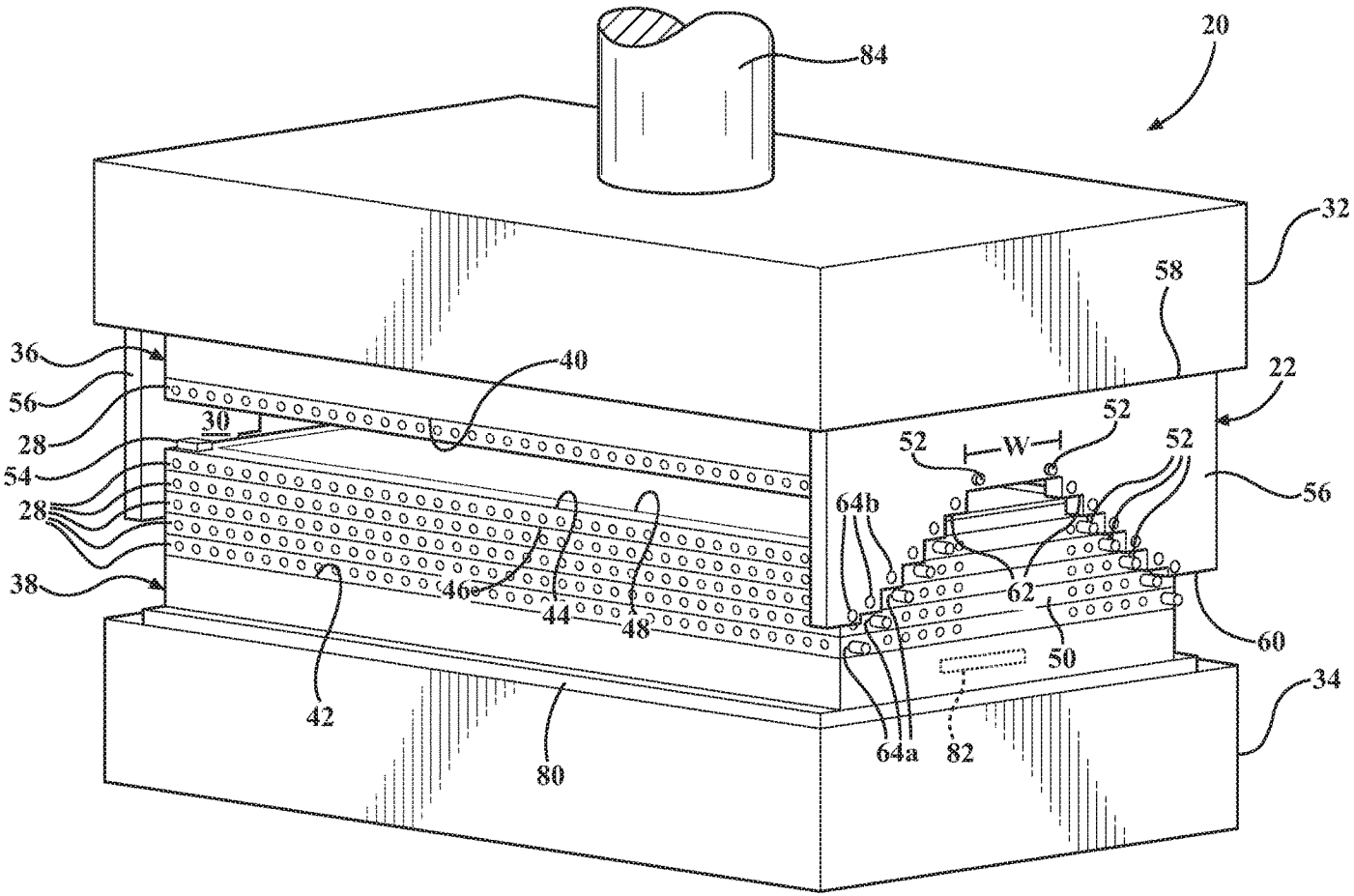
FIG. 2A is a perspective view of the press assembly of FIG. 1A in a second open position.
Figure 2B:
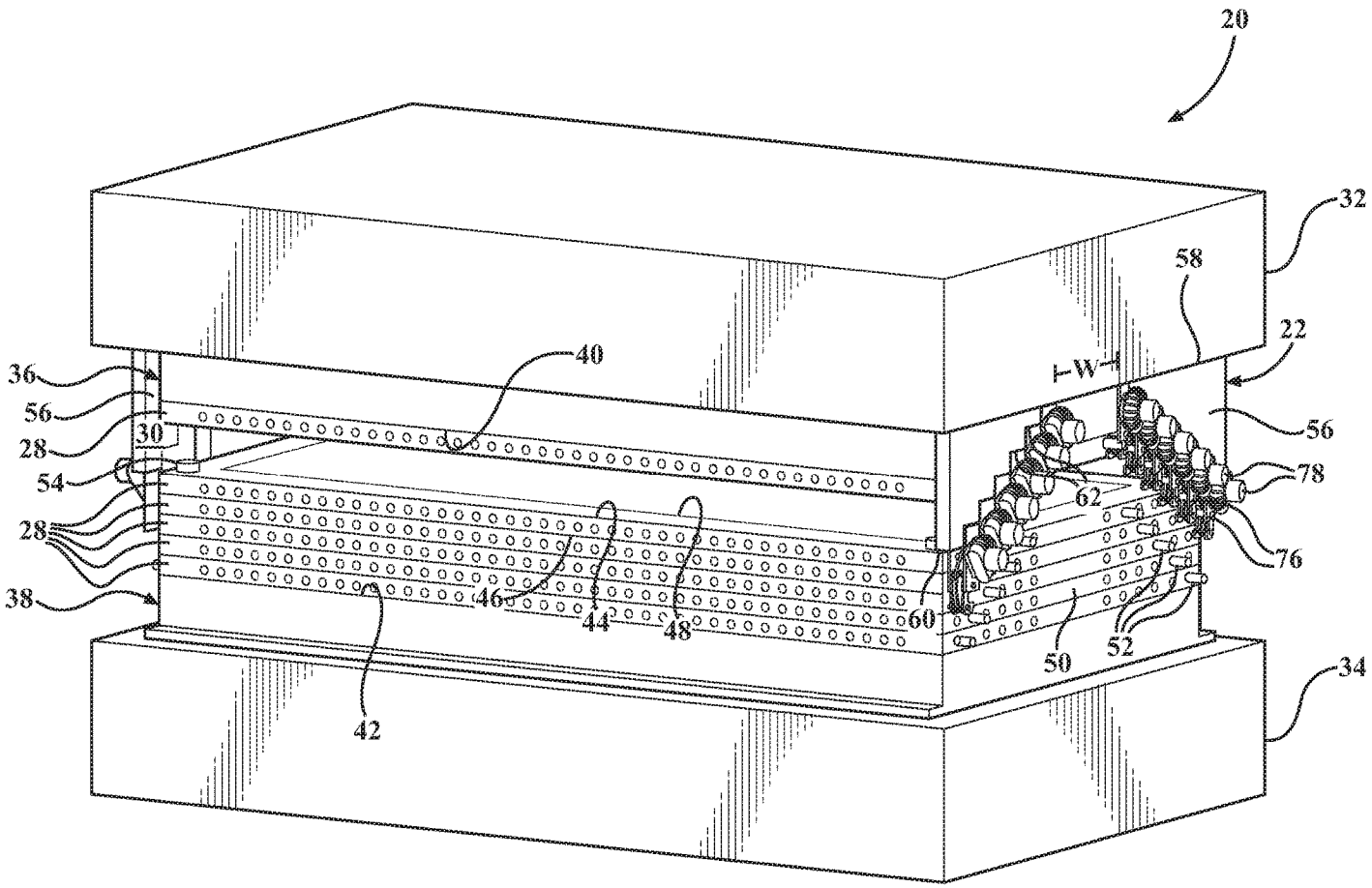

FIGS. 2A and 2B show the multi-window platen oven 22 in a second open position. In the embodiment of FIG. 2A, the pins 52 extend through the pin openings 64*a* of the first shelf 28 and the pin openings 64*b* beneath the first (uppermost) ledge 62 of the side walls 56 to attach the first shelf 28 to the upper press bed 32 while the remaining five shelves 28 remain unattached. In the embodiment of FIG. 2B, the pins 52 of the first shelf 28 are engaged by the hooks 76 attached to the first ledge 62, while the pins 52 of the remaining five shelves 28 are not engaged by the hooks 76. Thus, when the upper press bed 32 and attached side walls 56 move upward away from the lower press bed 34, the first shelf 28 moves upward along with the upper press bed 32 to present the second window 30 between the first shelf 28 and the second shelf 28. In the second open position, the aluminum blanks can be inserted into the second window 30 and disposed on the second shelf 28 for heating, or removed from the second shelf 28 for subsequent forming. The five shelves 28 which are not lifted remain resting on the lower press bed 34 and the other six windows 30 remain closed. Thus, any aluminum blanks disposed on the other shelves 28 or on the lower platen 38 remain sealed or protected from the environment and continue to be heated while the second window 30 is open.

Figure 3A:
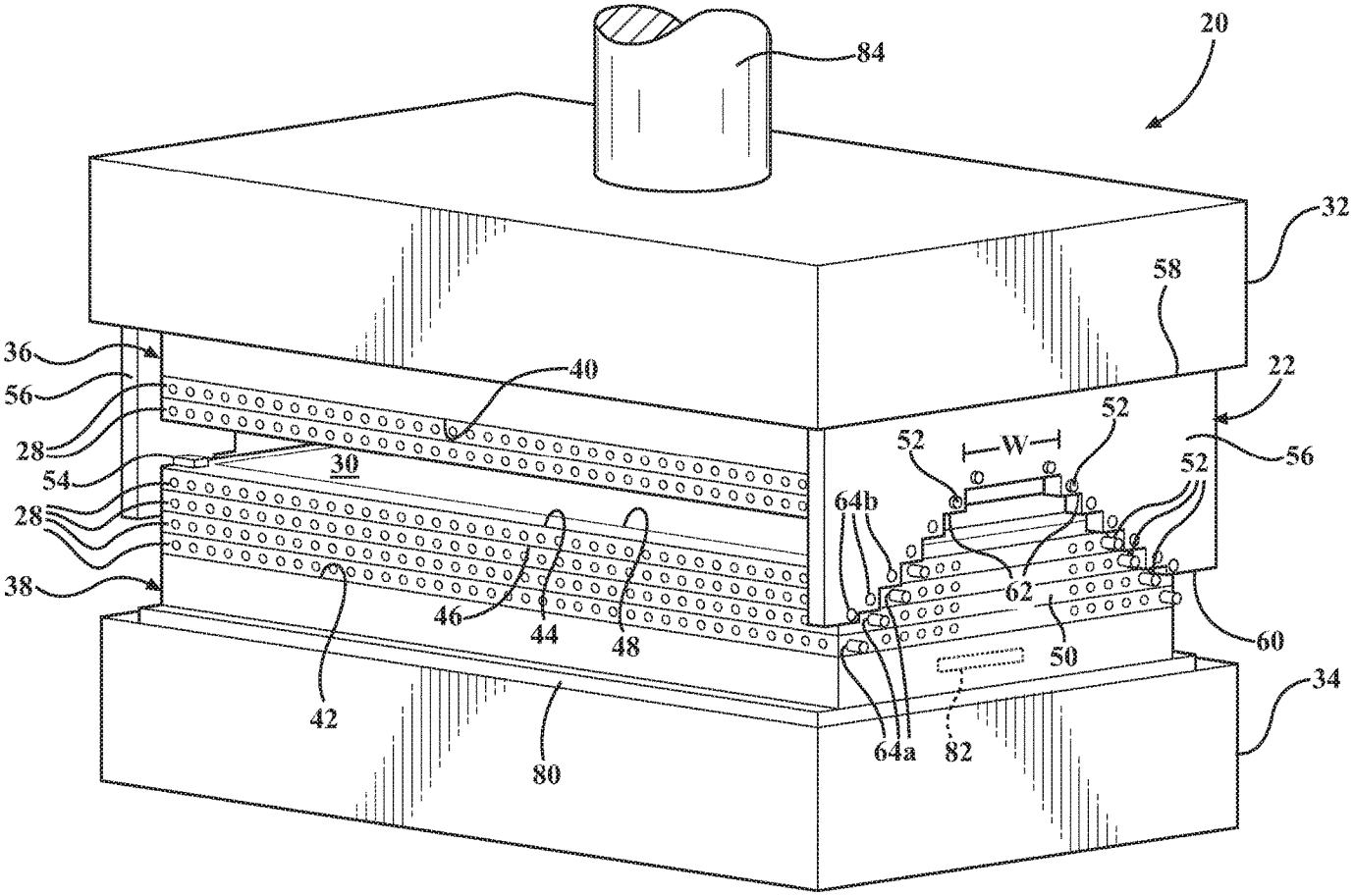
FIG. 3A is a perspective view of the press assembly of FIG. 1A in a third open position.
Figure 3B:
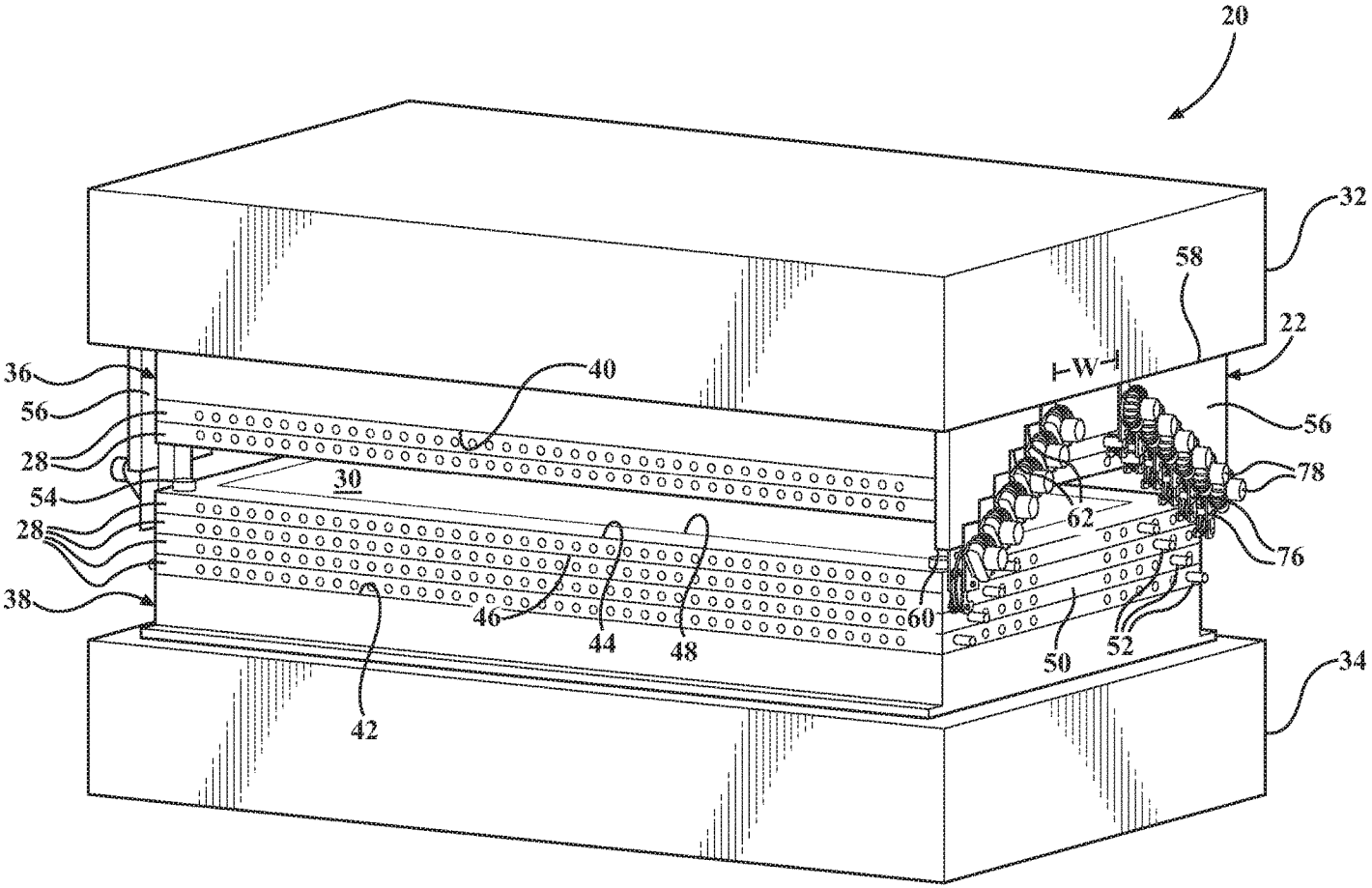

FIGS. 3A and 3B show the multi-window platen oven 22 in a third open position. In the embodiment of FIG. 3A, the pins 52 of the first and second shelves 28 extend into the pin openings 64*a* and 64*b* along the first ledge 62 and the second ledge 62 to attach the first and second shelves 28 to the upper press bed 32 while the remaining four shelves 28 remain unattached. In the embodiment of FIG. 3B, the pins 52 of the first and second shelves 28 are engaged by the hooks 76 attach to the first and second shelves 28 to the upper press bed 32 while the pins 52 of the remaining four shelves 28 are not engaged by the hooks 76. Thus, when the upper press bed 32 and attached side walls 56 move upward away from the lower press bed 34, the first and second shelves 28 move upward with the upper press bed 32 to present the third window 30 between the second shelf 28 and the third shelf 28. In the third open position, the aluminum blanks can be inserted into the third window 30 and disposed on the third shelf 28 for heating, or removed from the third shelf 28 for subsequent forming. The four shelves 28 which are not lifted remain resting on the lower press bed 34 and the other six windows 30 remain closed. Any aluminum blanks disposed on the other shelves 28 or on the lower platen 38 remain sealed or at least protected from the environment and continue to be heated while the third window 30 is open.

Figure 4A:
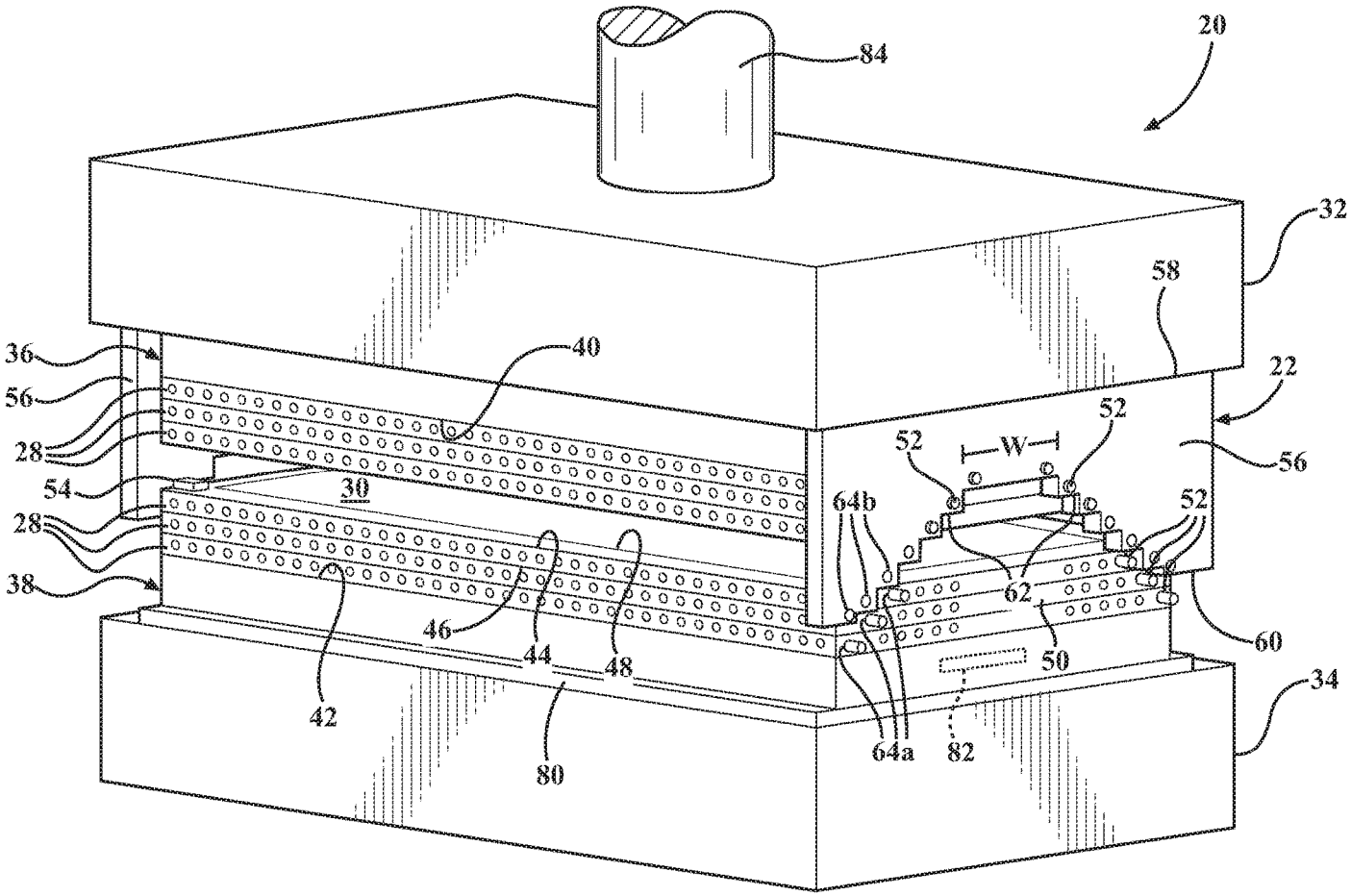
FIG. 4A is a perspective view of the press assembly of FIG. 1A in a fourth open position.
Figure 4B:
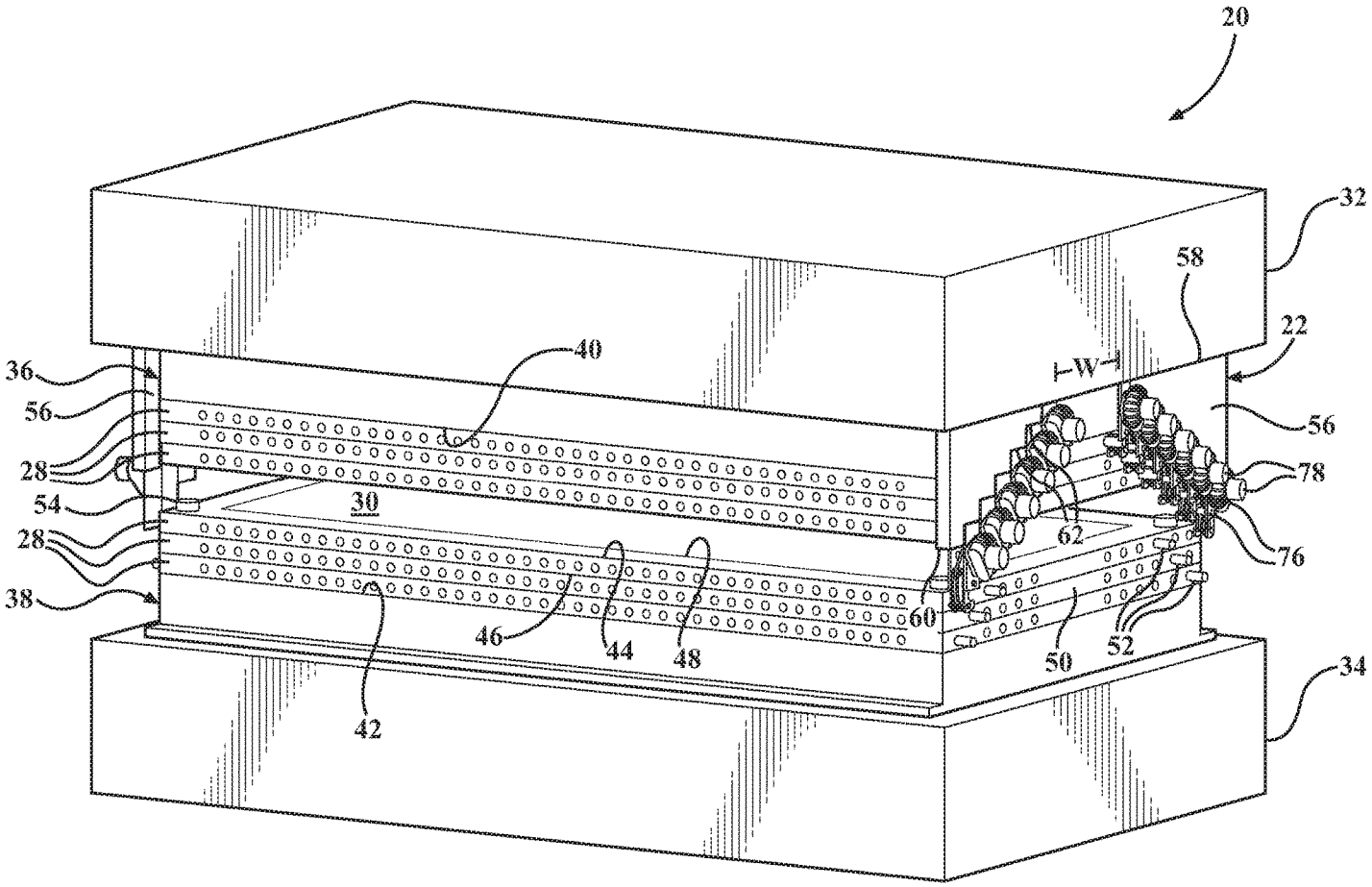

FIGS. 4A and 4B show the multi-window platen oven 22 in a fourth open position. In the embodiment of FIG. 4A, the pins 52 extend into the corresponding pin openings 64*a* and 64*b* along the first, second, and third shelves to attach the three shelves to the upper press bed 32 while the remaining three shelves 28 are unattached. In the embodiment of FIG. 4B, the pins 52 received in the pin openings 64*a* of the first, second, and third shelves 28 are engaged by the corresponding hooks 76, while the pins 52 of the remaining three shelves 28 are not engaged by the hooks 76. Thus, when the upper press bed 32 and attached side walls 56 move upward away from the lower press bed 34, the first shelf 28, second shelf 28, and third shelf 28 move upward with the upper press bed 32 to present the fourth window 30 between the third shelf 28 and the fourth shelf 28. In the fourth open position, the aluminum blanks can be inserted into the fourth window 30 and disposed on the fourth shelf 28 for heating, or removed from the fourth shelf 28 for subsequent forming. The three shelves 28 which are not lifted remain resting on the lower press bed 34 and the other six windows 30 remain closed. Any aluminum blanks disposed on the other shelves 28 or on the lower platen 38 remain sealed or protected from the environment and continue to be heated while the fourth window 30 is open.

Figure 5A:
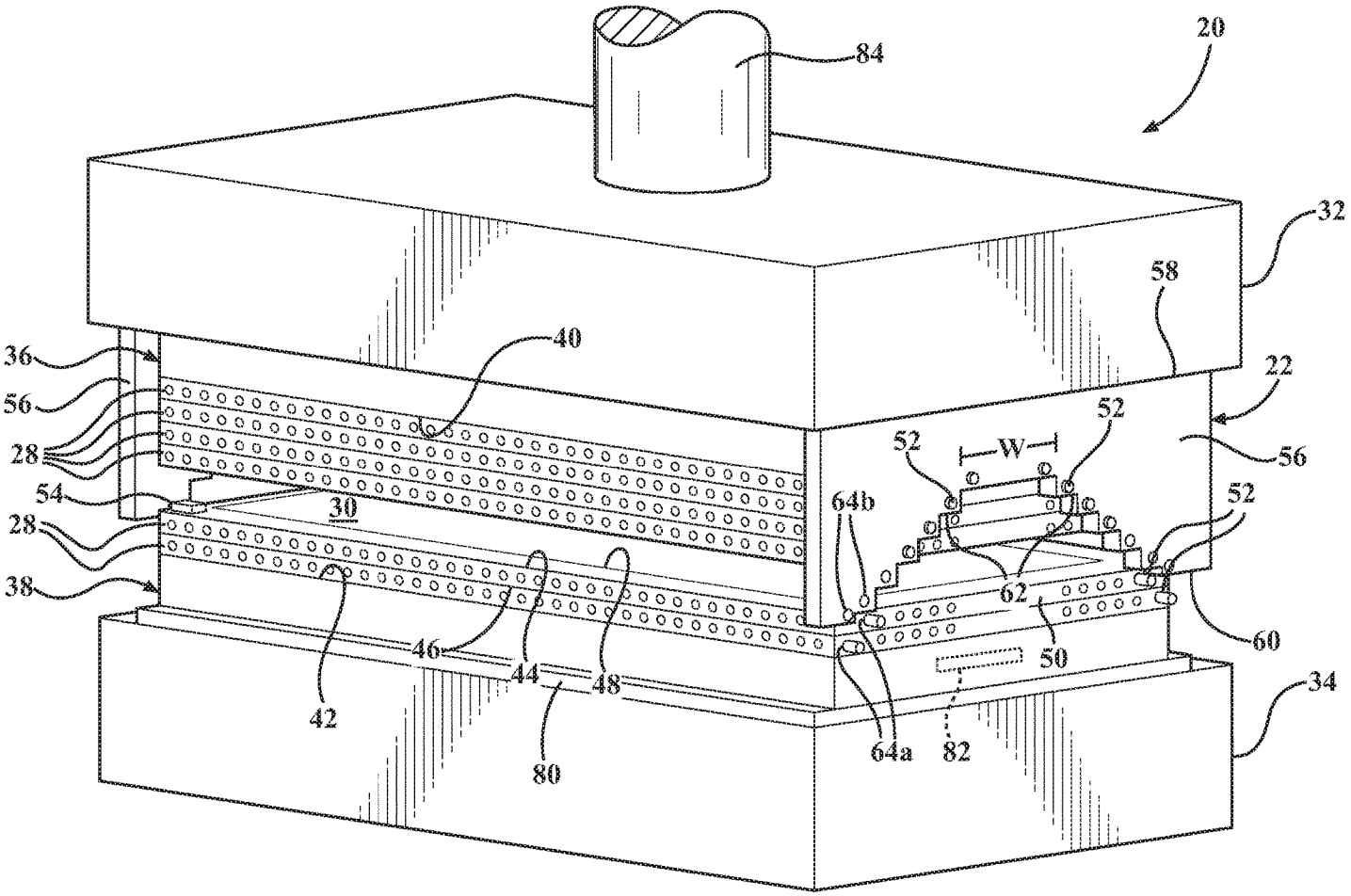
FIG. 5A is a perspective view of the press assembly of FIG. 1A in a fifth open position.
Figure 5B:
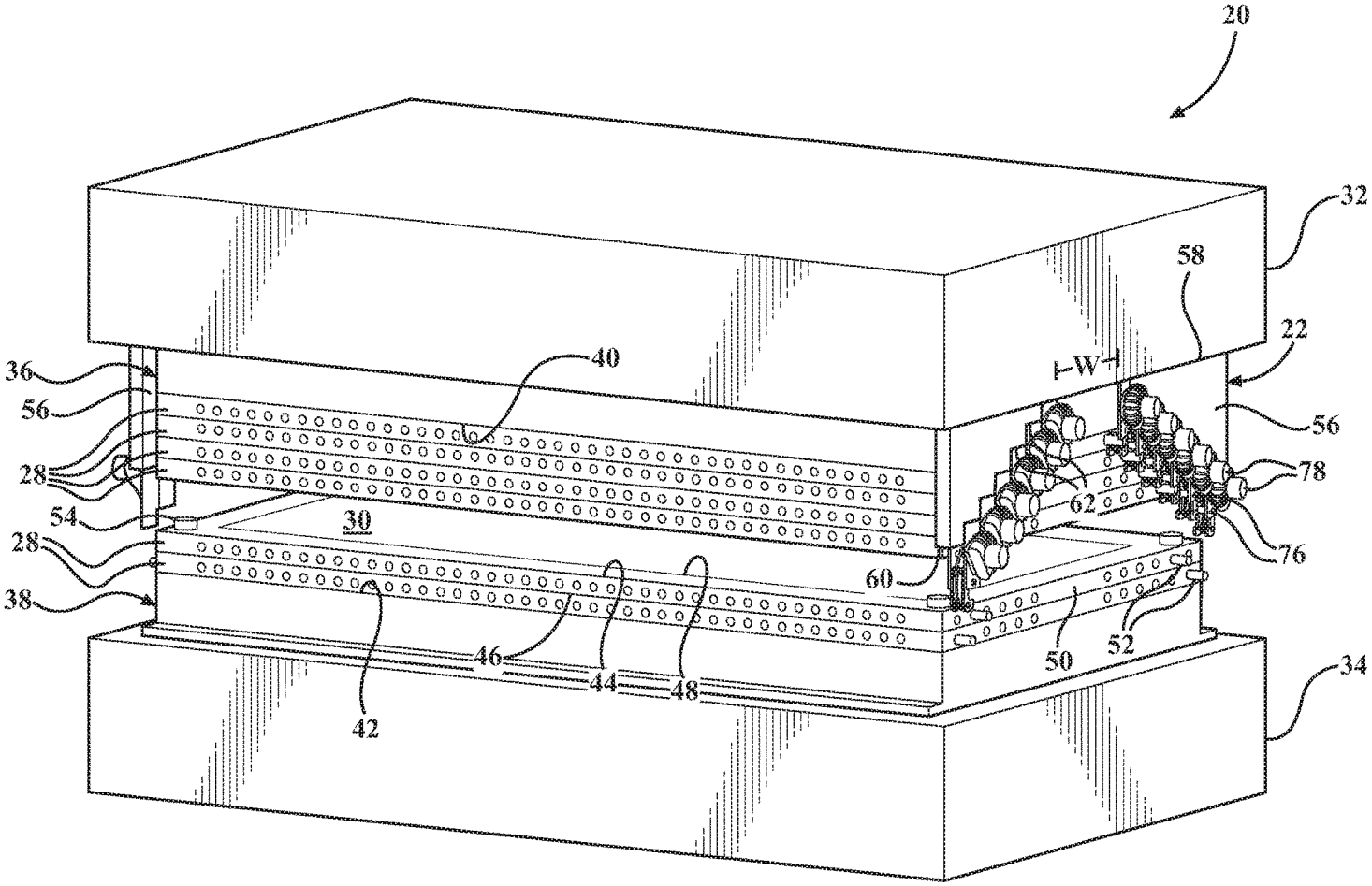

FIGS. 5A and 5B show the multi-window platen oven 22 in a fifth open position. In the embodiment of FIG. 5A, the pins 52 extend into the corresponding pin openings 64*a* and 64*b* along the first, second, third, and fourth shelves 28 while the two remaining shelves 28 are not attached. In the embodiment of FIG. 5B, the pins 52 of the first, second, third, and fourth shelves 28 are engaged by the corresponding hooks 76, while the pins 52 of the remaining two shelves 28 are not engaged by the hooks 76. Thus, when the upper press bed 32 and attached side walls 56 move upward away from the lower press bed 34, the first, second, third, and fourth shelves 28 move upward with the upper press bed 32 to present the fifth window 30 between the fourth shelf 28 and the fifth shelf 28. In the fifth open position, the aluminum blanks can be inserted into the fifth window 30 and disposed on the fifth shelf 28 for heating, or removed from the fifth shelf 28 for subsequent forming. The two shelves 28 which are not lifted remain resting on the lower press bed 34 and the other six windows 30 remain closed. Any aluminum blanks disposed on the other shelves 28 or on the lower platen 38 remain sealed or protected from the environment and continue to be heated while the fifth window 30 is open.

FIGS. 6A and 6B show the multi-window platen oven 22 in a sixth open position. In the embodiment of FIG. 6A, the pins 52 extend into the corresponding pin openings 64*a* and 64*b* along the first, second, third, fourth, and fifth shelves 28 while the sixth shelf 28 remains unattached. In the embodiment of FIG. 6B, the pins 52 of the first, second, third, fourth, and fifth shelves 28 are engaged by the corresponding hooks 76, while the pins 52 of the sixth shelf 28 are not engaged by the hooks 76. Thus, when the upper press bed 32 and attached side walls 56 move upward away from the lower press bed 34, the first, second, third, fourth, and fifth shelves 28 move upward with the upper press bed 32 to present the sixth window 30 between the fifth shelf 28 and the sixth shelf 28. In the sixth open position, the aluminum blanks can be inserted into the sixth window 30 and disposed on the sixth shelf 28 for heating, or removed from the sixth shelf 28 for subsequent forming. The sixth shelf 28 is not lifted and remains resting on the lower press bed 34 and the other six windows 30 remain closed. Any aluminum blanks disposed on the other shelves 28 or on the lower platen 38 remain protected from the environment and continue to be heated while the sixth window 30 is open.

FIGS. 7A and 7B show the multi-window platen oven 22 in a seventh open position. In the embodiment of FIG. 7A, the pins 52 extend into the corresponding pin openings 64*a* and 64*b* along all six shelves 28. In the embodiment of FIG. 7B, the pins 52 of all six shelves 28 are engaged by the corresponding hooks 76. Thus, when the upper press bed 32 and attached side walls 56 move upward away from the lower press bed 34, all of the shelves 28 move upward with the upper press bed 32 to present the seventh window 30 between the sixth shelf 28 and the lower platen 38. In the seventh open position, the aluminum blanks can be inserted into the seventh window 30 and disposed on the lower platen 38 for heating, or removed from the lower platen 38 for subsequent forming, while the other six windows 30 remain closed. Any aluminum blanks disposed on the shelves 28 above the lower platen 38 remain sealed or protected from the environment and continue to be heated while the seventh window 30 is open.

FIGS. 8A and 8B show the multi-window platen oven 22 in the closed position. In the closed position, the upper press bed 32 rests on all of the shelves 28, such that all of the shelves 28 and platens 36, 38 are pressed together, and no windows 30 are open. In this position, the aluminum blanks disposed on each of the shelves 28 and on the lower platen 38 are heated while being sealed or protected from the environment, and no blanks are transferred in or out of the oven 22. It should be appreciated that the positions of the press assembly 20 and multi-window platen oven 22 shown in FIGS. 1A-8A and 1B-8B could be achieved in any order. For example, the multi-window platen oven 22 could initially enter the fifth open position of FIGS. 5A and 5B, followed by the seventh open position of FIGS. 7A and 7B, and then the second open position of FIGS. 2A and 2B. Alternatively, the multi-window platen oven 22 could enter the first open position last, or the seventh open position first.

The invention also provides a method of forming the aluminum blanks into parts having a desired shape using the multi-window oven assembly. This method is typically a warm forming method, but alternatively could be a hot forming method. Due to the continuous heating of multiple blanks provided by the multi-window platen oven 22, the plurality of aluminum blanks can be efficiently formed into parts having the desired shape. The method is oftentimes used to form sheets of an aluminum alloy into deep drawn parts for automotive vehicle applications, such as highly curved door panels, door skins or other automotive body components. The method could also be used to form chassis components, such as pillars or columns for automotive vehicles. However, it should be appreciated that the multi-window oven assembly and method of the subject invention could be used to manufacture other products.

Figure 9:
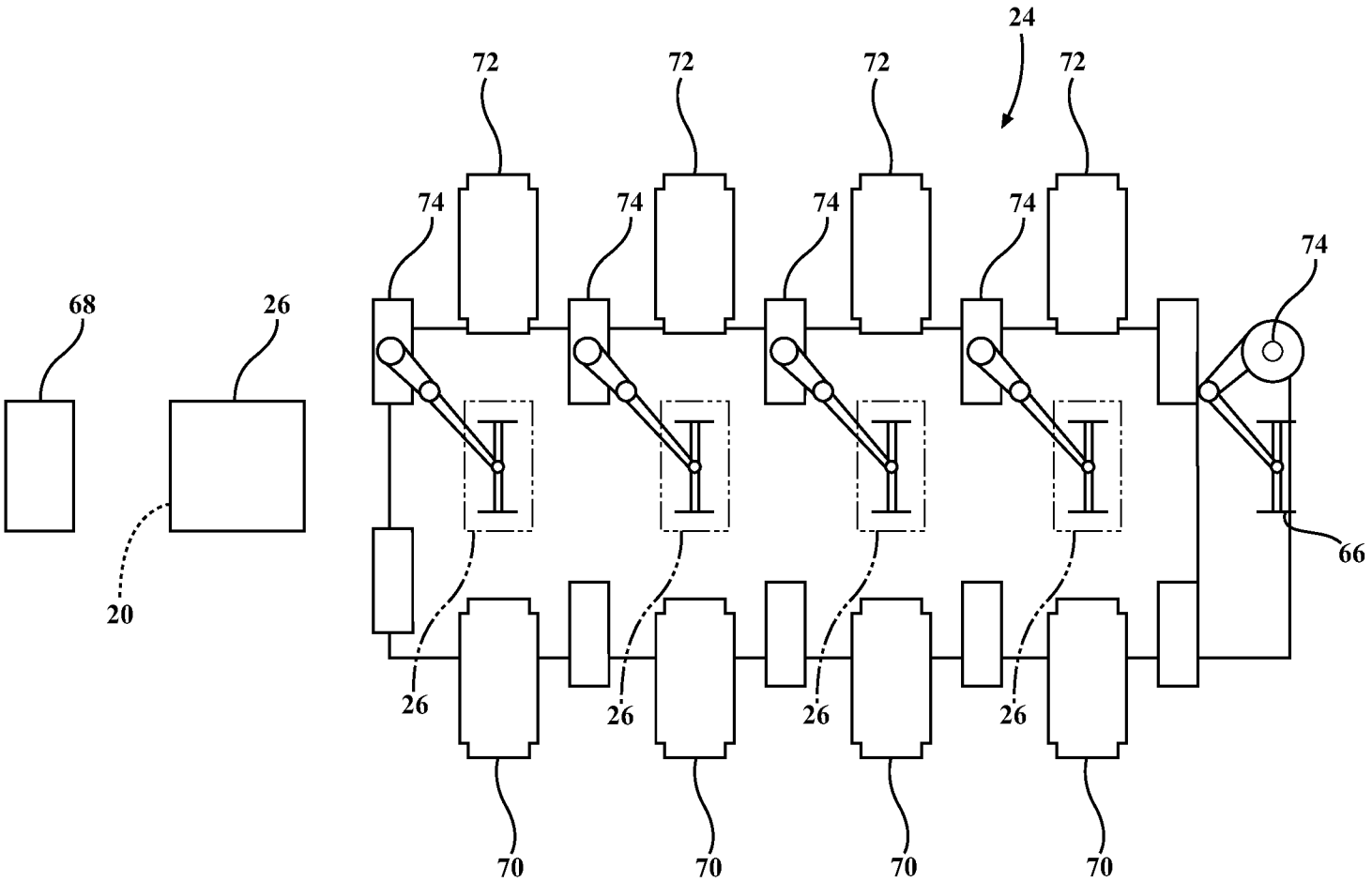
FIG. 9 is a top view of an exemplary aluminum warm forming production line including the press assembly with the multi-window platen oven.

An exemplary production line 24 used to form aluminum parts, specifically door panels 66 for an automotive vehicle, is shown in FIG. 9. The press assembly 20 including the multi-window platen oven 22 fits into one station 26 of an existing production line, typically when the existing production line does not already include a platen oven 22. Disposing the press assembly 20 and multi-window platen oven 22 in one station 26 provides the existing production line the ability to warm or hot form parts, such as deep drawn aluminum parts, when it otherwise would not be able to do so because of limited floor space. This is a significant advantage as floor space is oftentimes limited and does not allow for a platen oven to be disposed adjacent the production line.

In the embodiment of FIG. 9, the press assembly 20 including the multi-window platen oven 22 is disposed in a station 26 at the beginning of the production line 24, immediately following a first workstation 68 used to prepare the aluminum blanks. However, the press assembly 20 could alternatively be disposed in one of the other stations 26, or could be disposed at any other location along or adjacent the production line 24. The press assembly 20 could also be disposed in multiple locations, for example in multiple stations 26 along the production line 24.

The multi-window platen oven 22 can be placed on a bolster 80 and can easily slide in and out of the press assembly 20 on the bolster 80. For example, the bolster 80 can be coupled to the shelves 28 and can slide the shelves 28 horizontally into vertical alignment with the press beds 32, 34. The entire press assembly 20 can also slide in and out of one of the stations 26. For example, when the production line 24 is used to form parts that do not require the heating step, the multi-window platen oven 22 can be removed from the production line 24. Thus, the multi-window platen oven 22 can be treated like a tool, and the same production line can be used for both the aluminum warm forming process and also other manufacturing processes.

Additional stations 26 typically follow the first station 26 including the multi-window platen oven 22. For example, the production line 24 of FIG. 9 includes four stations 26 following the press assembly 20, but the number of stations 26 can vary depending on the shape of the parts to be formed.

The example production line 24 shown in FIG. 9 is a tandem production line capable of forming parts of two different designs. Thus, the production line 24 includes a plurality of first tools 70 for forming a first part having a predetermined shape, and a plurality of second tools 72 for forming a second part having a predetermined shape which is different from the first part. The shape of the tools 70, 72 varies depending on the desired shape of the parts to be formed. When the production line 24 is used to form the first part, the first tools 70 are disposed at the stations 26 which do not contain the press assembly 20, and when the production line 24 is used to form the second part, the second tools 72 are disposed at the stations 26 which do not contain the press assembly 20. The first tools 70 and the second tools 72 can slide in and out of the stations 26, as needed. For example, the production line 24 can be used to manufacture the same type of part, such as an automotive body panel, for two different customers requiring different designs. In this case, the first tools 70 are used to manufacture the first parts for the first customer, and once the first parts are complete, the first tools 70 slide out of the stations 26 and are replaced by the second tools 72 for manufacturing the second parts for the second customer. In the exemplary embodiment, robots 74 are used to transfer the blanks from the platen oven 22 to the second station 26, and then from one station 26 to the next station 26. However, other mechanisms can be used to move the blanks through the production line 24. The robots 74, as well as a lubrication system and destacking unit of a current production line can be utilized in the production line 24 of FIG. 9.

The method of forming the aluminum parts begins by disposing a plurality of aluminum blanks in the multi-window platen oven 22. The aluminum blanks are typically disposed on each shelf 28 and lower platen 38, one right after the other. The blanks can occupy all of the shelves 28, or fewer than all of the shelves 28, depending on the production volume and production time desired. Typically, the first aluminum blank to be disposed in the platen oven 22 is the first blank to be removed from the platen oven 22 and transferred to the next station 26, which is the station 26 closest to the platen oven 22. The amount of time each aluminum blank remains in the platen oven 22 depends on the temperature required to form the blank to the desired shape. In the warm forming process, the aluminum blank is heated and formed at a temperature of about 200-400° C. In a hot forming process, the aluminum blank is heated and formed at a temperature greater than 400° C.

The platen oven 22 is operated such that as soon as one aluminum blank reaches the required temperature, the window 30 containing that blank opens and the robot 74 transfers the heated blank from the shelf 28 or lower platen 38 to the following station 26. Immediately after the robot 74 removes that heated blank from the shelf 28 or lower platen 38, another unheated blank is disposed on the open shelf 28 or lower platen 38. For example, the method can include disposing a first blank on the first (uppermost) shelf 28, followed by disposing a second blank on the second shelf 28, and then disposing a third blank on the third shelf 28, etc. Once the first blank reaches the desired temperature, the first window 30 opens, as shown in FIGS. 1A and 1B, and the first blank is removed from the first shelf 28 and transferred to the next station 26, referred to as the second station 26. The other windows 30 remain closed so that the blanks disposed on the other shelves 28 and lower platen 38 continue to be heated while the first blank is transferred to the second station 26. Also, while the first window 30 is open and the first blank is being transferred to the second station 26, an unheated blank is placed on the open first shelf 28. The first window 30 then closes, as shown in FIGS. 8A and 8B, to heat the blanks remaining in the platen oven 22 while the first blank is formed at the second station 26. Once the first blank is almost ready to move from the second station 26 to the third station 26, the second window 30 of the platen oven 22 opens, as shown in FIGS. 2A and 2B. Immediately after the first blank is transferred from the second station 26 to the third station 26, the second blank is removed from the second shelf 28 and transferred to the second station 26. While the second window 30 is open and the second blank is being transferred to the second station 26, another unheated blank is disposed on the open second shelf 28. The second window 30 then closes, as shown in FIGS. 8A and 8B, to heat the blanks remaining in the platen oven 22 while the first blank is formed at the third station 26 and the second blank is formed at the second station 26. These steps are repeated so that unheated blanks are continuously transferred to the platen oven 22, and heated blanks are continuously transferred from the platen oven 22 to the second station 26. The heated blanks continuously move from the platen oven 22 through the station 26, without delay, until the desired number of aluminum parts is formed.

Many modifications and variations of the present invention are possible in light of the above teachings and may be practiced otherwise than as specifically described while within the scope of the claims.

The invention claimed is:

1. A method of forming a plurality of parts in a production line, comprising the steps of:

providing a multi-window oven assembly including an upper press bed, a lower press bed vertically aligned with the upper press bed, wherein at least one of the press beds is movable vertically relative to the other press bed, a plurality of shelves vertically aligned with and disposed between the press beds for receiving a plurality of blanks, wherein at least one of the shelves is coupled to one of the press beds, and at least two of the shelves are heated for simultaneously heating the plurality of blanks;

disposing at least one blank on at least two of the shelves or on the lower press bed and at least one shelf;

simultaneously heating the at least two shelves and the blanks disposed on the heated shelves;

forming the heated blanks in the production line after heating the blanks with the multi-window oven assembly, and wherein the step of forming the heated blanks is conducted in a plurality of tools, the tools include a plurality of first tools having a first design and a plurality of second tools having a second design different from the first design; and further including the steps of:

moving the first tools into position in the production line;

forming a first set of the blanks using the first tools after heating the first set of blanks in the multi-window oven assembly;

sliding the first tools out of the production line after forming the first set of heated blanks;

moving the second tools into alignment with the multi-window oven assembly in the production line after sliding the first tools out of the production line; and forming a second set of the blanks using the second tools after heating the second set of blanks in the multi-window oven assembly.

2. The method of claim 1, wherein the shelves are disposed between a pair of platens, and including moving at least one of the upper press bed and the lower press bed and any coupled shelves vertically away from the remaining shelves and press bed to present an open window between a pair of the shelves or between one of the shelves and one of the platens for receiving the at least one blank while the remaining shelves and platens engage one another.

3. The method of claim 2 including attaching at least one of the shelves to the upper press bed and moving the upper press bed and attached shelves vertically relative to the remaining shelves and the lower press bed to present the open window; disposing at least one of the blanks on the shelf or lower press bed and removing at least one of the heated blanks from the shelf or lower press bed for subsequent forming while the window is open and the remaining shelves and platens engage one another.

4. A multi-window oven assembly for simultaneously heating a plurality of blanks, comprising:

an upper press bed;

a lower press bed vertically aligned with said upper press bed, at least one of said press beds being movable vertically relative to the other press bed;

a plurality of shelves vertically aligned with and disposed between said press beds for receiving a plurality of blanks, at least one of said shelves being coupled to one of said press beds, at least two of said shelves being heated for simultaneously heating the plurality of blanks;

an upper platen disposed between said shelves and said upper press bed and attached to said upper press bed, said upper platen being heated and presenting an upper platen surface for facing said blanks;

a lower platen disposed between said shelves and said lower press bed, said lower platen being heated and presenting a lower platen surface for supporting said blanks;

at least one heating device disposed along said shelves for heating said platens and said shelves to a temperature of at least 200° C.;

an attachment assembly coupled to said upper press bed for attaching at least one shelf to said upper press bed, said attachment assembly including a pair of side walls extending longitudinally along opposite ends of said shelves toward said lower press, each of said side walls including a plurality of pin openings aligned with pin openings in said ends of said shelves for receiving a plurality of pins, wherein the pins couple said shelves to said upper press bed;

a press actuator for moving said upper press bed and said attached shelves vertically relative to said lower press bed to present an open window between said upper press bed and said lower press bed for receiving and heating at least one of said blanks; and wherein each shelf is planar and parallel to the adjacent shelf, each shelf presents an upper shelf surface facing toward said upper press bed and a lower shelf surface facing toward said lower press bed, each lower shelf surface and said lower platen surface presents a recessed area for receiving said at least one blank, and said recessed area along said open window receives at least one of said blanks while each of the remaining shelves and platens engage one another to protect and heat a plurality of said blanks disposed in the remaining recesses.

5. The multi-window oven assembly of claim 4, wherein each shelf is attachable to at least one adjacent shelf or press bed and movable vertically with said at least one adjacent shelf or press bed.

6. A production line for forming a plurality of parts, comprising:

at least one tool for forming heated blanks;

a multi-window oven assembly disposed before the at least one tool for simultaneously heating a plurality of the blanks, said multi-window oven assembly including:

an upper press bed, a lower press bed vertically aligned with said upper press bed, wherein at least one of said press beds is movable vertically relative to the other press bed, a plurality of shelves vertically aligned with and disposed between said upper press bed and said lower press bed for receiving a plurality of blanks, wherein at least one of said shelves is coupled to one of said press beds, and at least two of said shelves are heated for simultaneously heating the plurality of the blanks, and wherein the multi-window oven assembly is aligned with the at least one tool in the production line.

7. The production line of claim 6, wherein each shelf is movable vertically relative to an adjacent shelf or press bed to present an open window for receiving at least one of said blanks between said shelf and said adjacent shelf or press bed; and wherein each shelf is attachable to at least one adjacent shelf or press bed and movable vertically with said at least one adjacent shelf or press bed.

8. A method for simultaneously heating a plurality of blanks, comprising the steps of:

providing a multi-window oven assembly including an upper press bed, a lower press bed vertically aligned with the upper press bed, and a plurality of shelves vertically aligned with and disposed between the press beds, wherein at least one of the press beds is movable vertically relative to the other press bed, and at least one of the shelves is coupled to at least one of the upper press bed and the lower press bed;

disposing at least one blank on at least two of the shelves or on the lower press bed and at least one shelf;

simultaneously heating the at least two shelves;

wherein the shelves are disposed between a pair of platens, and including moving at least one of the upper press bed and the lower press bed and any coupled shelves vertically away from the remaining shelves and press bed to present an open window between a pair of the shelves or between one of the shelves and one of the platens for receiving the at least one blank while the remaining shelves and platens engage one another; and wherein the step of simultaneously heating the at least two shelves occurs during the step of moving the at least one of the upper press bed and the lower press bed and any coupled shelves vertically away from the remaining shelves and press bed to present the open window.

9. The method of claim 8 including sealing the blanks disposed on the at least two heated shelves from the environment while simultaneously heating the at least two shelves.

10. A method of forming a plurality of parts in a production line, comprising the steps of:

providing a multi-window oven assembly including an upper press bed, a lower press bed vertically aligned with the upper press bed, wherein at least one of the press beds is movable vertically relative to the other press bed, a plurality of shelves vertically aligned with and disposed between the press beds for receiving a plurality of blanks, wherein at least one of the shelves is coupled to one of the press beds, and at least two of the shelves are heated for simultaneously heating the plurality of blanks;

disposing at least one blank on at least two of the shelves or on the lower press bed and at least one shelf;

simultaneously heating the at least two shelves and the blanks disposed on the heated shelves; and forming the heated blanks in the production line after heating the blanks with the multi-window oven assembly, wherein the shelves are disclosed between a pair of platens, and including moving at least one of the upper press bed and the lower press bed and any coupled shelves vertically away from the remaining shelves and press bed to present an open window between a pair of the shelves or between one of the shelves and one of the platens for receiving at least one of the blanks while the remaining shelves and platens engage one another.

11. The method of claim 10, wherein the step of simultaneously heating the at least two shelves occurs during the step of moving the at least one of the upper press bed and the lower press bed and any coupled shelves vertically away from the remaining shelves and press bed to present the open window.

12. The method of claim 10 including attaching at least one of the shelves to the upper press bed and moving the upper press bed and attached shelves vertically relative to the remaining shelves and the lower press bed to present the open window; disposing at least one of the blanks on the shelf or lower press bed; and removing at least one of the heated blanks from the shelf or lower press bed while the window is open and the remaining shelves and platens engage one another.

* * * * *